United States Patent [19]

Brunton

[11] 4,167,084

[45] Sep. 11, 1979

[54] SWIMMING POOL WALL SYSTEM

[76] Inventor: Ernest W. Brunton, 120 St. Margaret's Rd., Ancaster, Ontario, Canada

[21] Appl. No.: 846,045

[22] Filed: Oct. 27, 1977

[30] Foreign Application Priority Data

Oct. 27, 1976 [GB] United Kingdom ..... 44726/76

[51] Int. Cl.[2] ..... E04H 3/18; E04C 1/00; E04B 2/08

[52] U.S. Cl. ..... 52/169.7; 4/172.19; 52/281; 52/285; 52/584

[58] Field of Search ..... 52/281, 169.7, 285, 52/288, 459, 461, 463, 464, 562, 571, 578, 582, 583, 584; 4/172.19

[56] References Cited

U.S. PATENT DOCUMENTS

| | | | |
|---|---|---|---|
| 2,953,225 | 9/1960 | Burgin | 52/281 |
| 3,445,866 | 5/1969 | Shields | 4/172.19 |
| 3,504,382 | 4/1970 | Schatzki | 4/172.19 |
| 3,512,326 | 5/1970 | Greene | 52/169.7 |
| 3,739,539 | 6/1973 | Posnick | 52/169.7 |
| 3,750,197 | 8/1973 | Weir et al. | 4/172.19 |
| 3,854,260 | 12/1974 | O'Hanlon | 52/584 |
| 3,934,277 | 1/1976 | Quirouette et al. | 4/172.19 |
| 3,950,907 | 4/1976 | Dahowski | 52/169.7 |
| 3,970,402 | 7/1976 | Yamashita | 52/584 X |

FOREIGN PATENT DOCUMENTS

| | | | |
|---|---|---|---|
| 2428342 | 1/1975 | Fed. Rep. of Germany | 4/172.19 |
| 383593 | 1/1965 | Switzerland | 52/395 |
| 1228458 | 4/1971 | United Kingdom | 4/172.19 |

*Primary Examiner*—J. Karl Bell

*Attorney, Agent, or Firm*—Arne I. Fors; Robert F. Delbridge

[57] ABSTRACT

A swimming pool sectional wall construction having connectors permitting quick assembly of wall components into a rigid, self-aligning structure. Panels comprising wall components have longitudinal flanges formed along each side edge defining an acute angle with the plane of each panel whereby flanges on adjacent panel edges diverge from each other. A connector, having a pair of opposed converging faces adapted to receive said diverging flanges, secures the adjacent panels in tight-fitting abutment.

Novel copings seated on the wall top edge permits detachable securement of a post liner thereto.

11 Claims, 9 Drawing Figures

10
10
16
12
16
14

32
48
52
50
38
40
42
46
36
34
44
26
28
12
23
30
24
19
23
25
25

21
12
12
15
2
10
20
18
22
10
2
15
20
14
14
90
54
74
66
62
76
70
80
88
78
72
64
68
56
82
28
42
60
84
58
86
30
26
23
18
44
14
10

SWIMMING POOL WALL SYSTEM

BACKGROUND OF THE INVENTION

This invention relates to a swimming pool wall system and is particularly directed to a novel sectional wall construction permitting quick assembly of wall components into a rigid unitary assembly.

Conventional known swimming pool constructions incorporate a plurality of wall panels secured together by directly joining abutting panel flanges through the use of securing means such as nuts and bolts or screws. Not only does this type of construction require considerable time for alignment and assembly of component parts but also the need for securing means necessitates the handling of a multiplicity of parts at the time of installation.

STATEMENT OF INVENTION

The present invention substantially obviates the foregoing disadvantages of conventional systems by providing a connector for joining together wall panels which aids the alignment of component parts and which is amenable to partial preassembly without the need of a great number of ancillary securing means. The connector assembly additionally provides the advantages of imparting lateral rigidity to the assembly, in order to counter lateral forces created by the water load contained in a swimming pool, if above ground, and to counter lateral forces from earth walls, if below ground, while providing support for a coping or deck structure.

In general, the sectional wall construction of my invention comprises in combination: a plurality of rectangular wall panels each having top and bottom edges and parallel side edges, a longitudinal flange formed along each side edge defining an acute angle with the plane of the panel, whereby said flanges diverge from each other to form an angle with each other when said panels are in alignment with or perpendicular to each other, and an elongated connector defining a pair of opposed converging faces adapted to receive said diverging flanges in abutment whereby said panels are rigidly connected together.

More particularly, the aforesaid connector can comprise an elongated post member having a pair of diverging slots formed along one side thereof adapted to form said opposed converging faces for receiving said flanges in abutment or a pair of elongated members each having an arcuate section and a planar section whereby said arcuate sections form opposed converging faces upon abutment of said planar sections upon each other for receiving said diverging flanges in abutment.

The wall construction includes novel aluminum or plastics copings adapted to seat on the wall top edge and to detachably secure a pool liner thereto.

BRIEF DESCRIPTION OF THE DRAWINGS

The construction of my invention is described in the accompanying drawings, in which.

DESCRIPTION OF THE PREFERRED EMBODIMENTS

Figures 1, 2, 3:
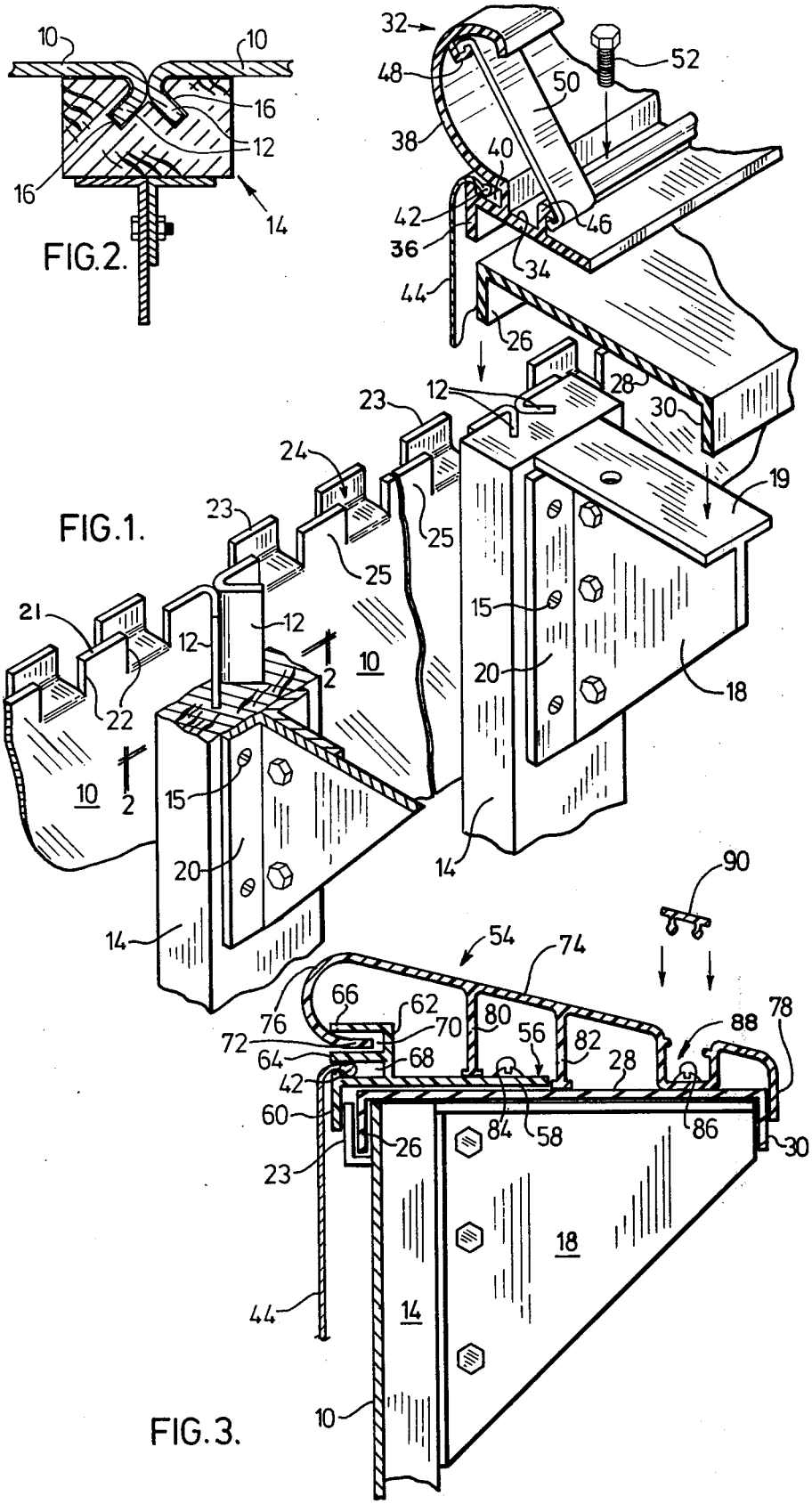
FIG. 1 is an exploded perspective view, partly cut away, of an embodiment of my invention showing a first version of a coping.
FIG. 2 is a section through line 2—2 of FIG. 1.
FIG. 3 is a vertical transverse section of the connector shown in FIG. 1 illustrating another version of coping.

With reference now to FIGS. 1–4 of the drawings, the embodiments of the wall construction of my invention illustrated comprise a plurality of wall panels 10 each having flanges 12 formed at each end defining an acute angle of about 30° to about 60°, preferably about 45°, to the plane of the wall panel, as shown most clearly in FIG. 2. Panels 10 are maintained in alignment in a common plane and are secured together by a connector 14 which comprises in the embodiment illustrated an elongated post member which may be rectangular in cross-section having a pair of diverging slots 16 formed along one side thereof at an angle of from about 120° to about 60°, preferably about 90°, with each other adapted to receive flanges 12 therein.

Panels 10 conventionally are formed of galvanized steel. Post members 14 can be formed of structural foam, such as of styrene or polyurethane by molding, or from extruded plastics such as polyvinyl chloride or acrylonitrile butadiene styrene.

A reinforcing gusset 18 formed integral with post 14 or separate from post 14 and secured thereto by rivets or screws 15 through flanges 20 provides lateral support and rigidity to post 14 and to the wall panels 10 secured thereto to accommodate the lateral loading from water contained in the swimming pool or from earth outside the swimming pool. The top edge of gusset 18 has T-flange 19 to receive a coping, to be described. Gusset 18 can be formed of roll-formed steel, aluminum or structural foam.

The top edge 21 of panel 10 can be slit 22 at equal intervals of about 15 cm and alternating sections 23 offset to form a projected recess 24 with remaining sections 25. Recess 24 can be used to receive front flange 26 of metal cap 28 adapted to seat on the top T-flange 19 of gussets 18. Rear flange 30 of cap 28 encloses the rear edge of gusset 18.

FIG. 1 illustrates a version of coping 32 which comprises an elongated extrusion of aluminum or a rigid plastics material such as polyvinyl chloride having a planar base 34, downwardly depending front flange 36 adapted to lap edge section 23, an arcuate section 38 depending upwardly from base 34 defining a recess 40 with base 34 for receiving the beaded edge 42 of vinyl liner 44, and a pair of opposed elongated ribs 46, 48 formed on base 34 and section 38, respectively, for receiving inter-connecting member 50 at spaced intervals along the length of coping 32 to provide rigidity thereto.

Coping 32 is secured to cap 28 by securing means such as screws or rivets 52.

FIG. 3 illustrates another version of coping 54. An aluminum or rigid plastics extrusion 56 having a planar base 58 is adapted to seat on cap 28 with downwardly depending front flange 60 adapted to lap edge section 23. Upwardly extending section 62 has forwardly depending ribs 64, 66 which define recesses 68, 70 respectively for receiving the beaded edge 42 of vinyl liner 44 in recess 68 and edge 72 of coping 54.

Coping 54 comprises an elongated extrusion of aluminum or rigid plastics having a rearwardly-inclined portion 74 with rounded front 76 and downwardly depending rear flange 78 adapted to overlie flange 30 of cap 28. A pair of ribs 80, 82 depending downwardly from the underside of top portion 74 abut cap 28 to provide rigidity to coping 54. Conventional securing means such as screws 84, 86 join coping 54 to cap 28 and to gusset 18. Screws 86 are seated in longitudinal recess 88 which is closed by strip 90 snap-fitted thereinto.

Figure 4:
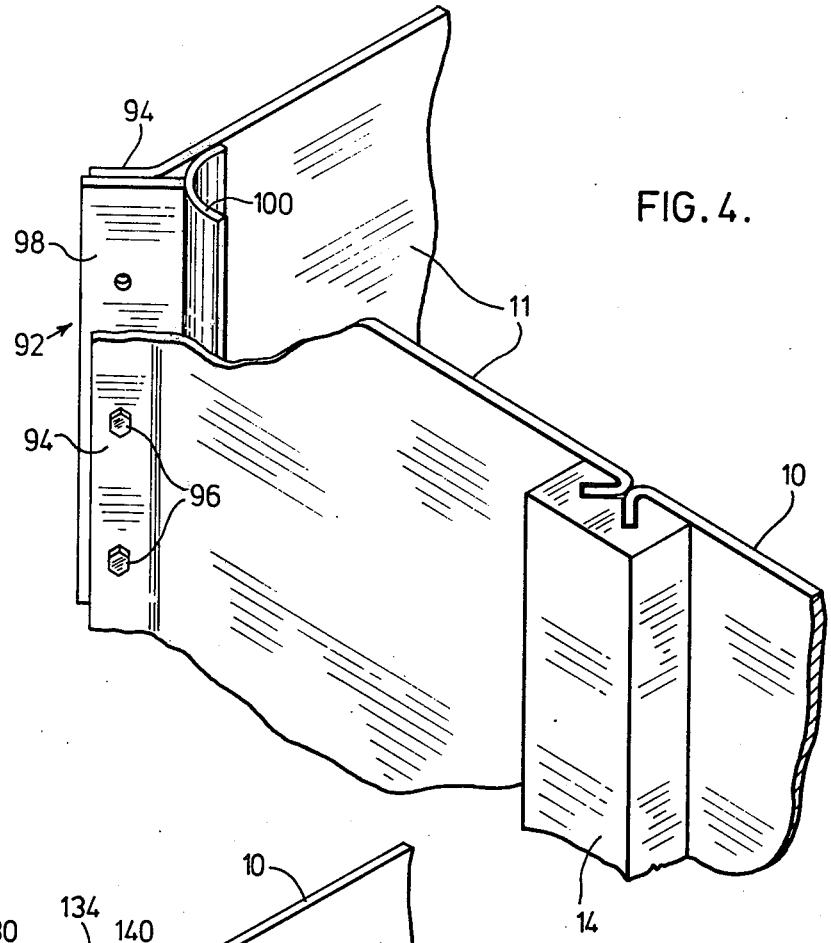
FIG. 4 is a perspective view of a wall incorporating the connector of FIG. 1.

FIG. 4 shows a corner connection 92 in which corner panels 11 have oblique flanges 94 joined together by bolts 96 with flange 98 of arcuate member 100 welded perpendicular thereto gripped therebetween. Arcuate member 100 provides a rounded inner corner for support of the pool vinyl liner.

Figure 5:
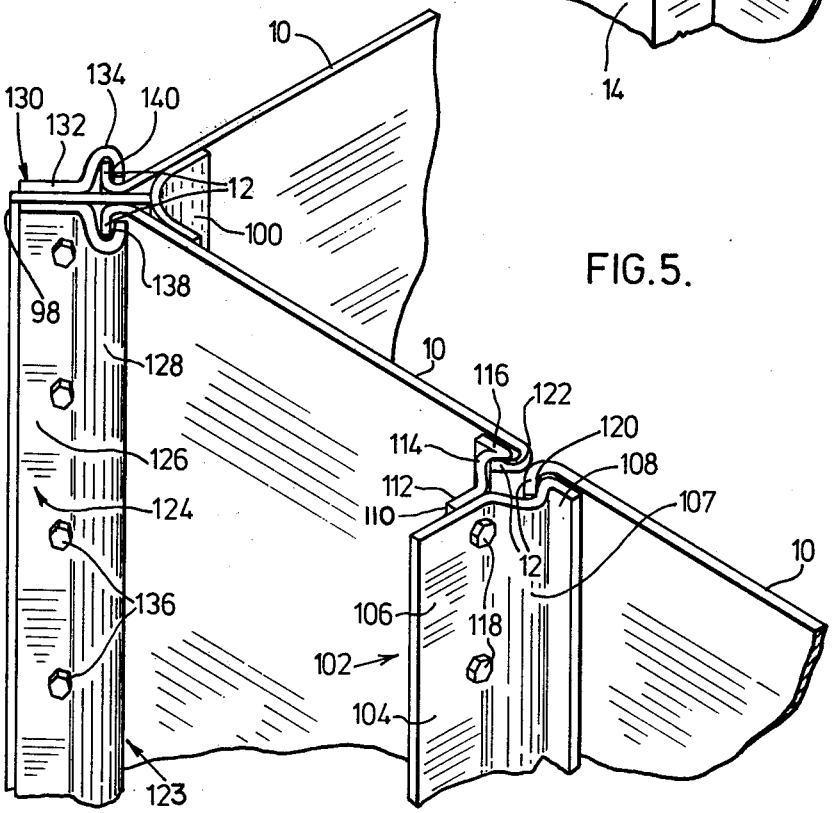
FIG. 5 is a perspective view of another embodiment of connector of the invention.

FIG. 5 illustrates a preferred embodiment of my invention in which panels 10 are connected together in planar alignment by connector 102 which consists of elongated metal member 104 having a planar section 106 and an integral arcuate section 107 with a reverse flange 108 formed along its free edge. Co-operating metal member 110 has a planar section 112 with arcuate section 114 and reverse flange 116 formed along its free edge. Members 104 and 110 are joined together by bolts 118 along planar sections 106, 112 whereby arcuate sections 107, 114 form opposed converging faces 120, 122 which engage diverging flanges 12 of panels 10. Panels 10 thus are locked together in planar alignment by converging faces 120, 122 engaging flanges 12 and reverse flanges 108, 116 abutting the outer surfaces of panels 10.

The corner connection is essentially established in like manner by connector 122 which comprises elongated metal member 124 having a planar section 126 and integral arcuate section 128. Co-operating metal member 130 having a planar section 132 and arcuate section 134 is secured to member 124 by bolts 136 whereby arcuate sections 128, 134 form opposed converging faces 138, 140 which engage diverging flanges 12 of panels 10. Panels 10 thus are locked together at right-angles to each other at the corner of the wall construction.

Figure 6:
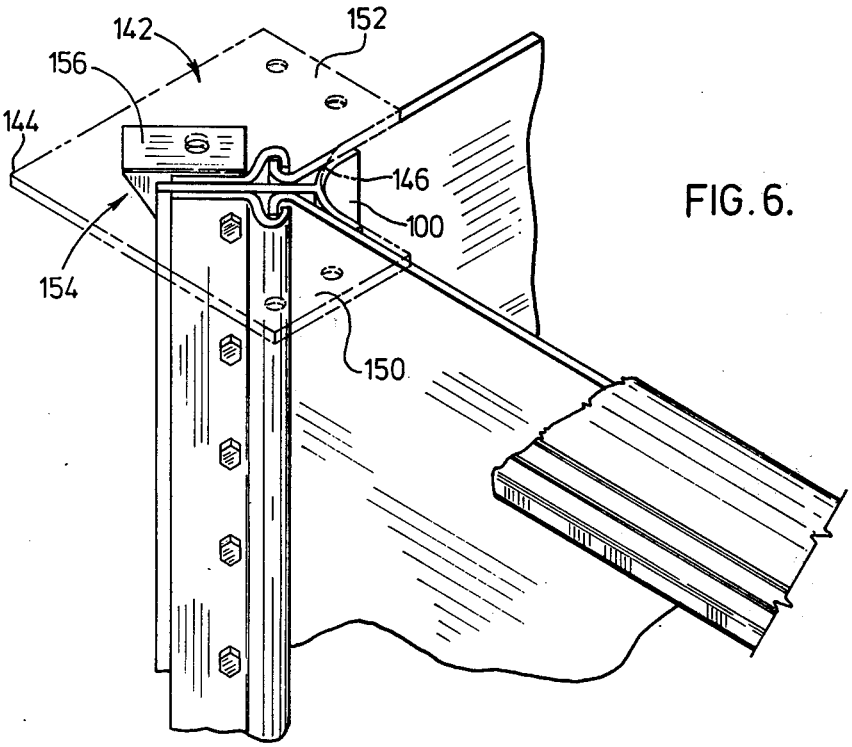
FIG. 6 is a perspective view of the connector of FIG. 5 with corner coping members.

With reference now to FIG. 6, a corner cap 142 is illustrated for joining abutting copings together. Cap 142, formed of aluminum or a rigid plastics material, has a square outer corner 144 and a rounded inner corner 146 which is coextensive with arcuate member 100. Wings 150, 152 underlie the ends of adjoining copings and are secured thereto by bolts, not shown. A corner gusset 154 has a top flange 156 to which cap 142 is secured by bolts, not shown.

Figure 7:
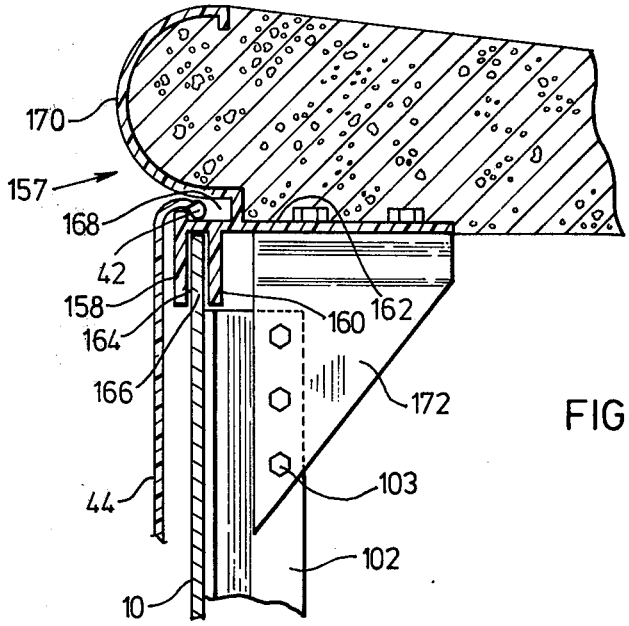
FIG.7 is a section of another version of coping.

FIG. 7 illustrates another embodiment of coping 157 extruded from aluminum or a rigid plastics material. A pair of spaced flanges 158, 160 depending from the front edge of planar base 162 defines recess 164 which is adapted to receive the upper edge 166 of panel 10. If coping 157 is made of aluminum, a strip formed of an inert material such as polyvinyl chloride, not shown, should be inserted over edge 166 to preclude corrosion between steel panels 10 and the aluminum coping.

A recess 168 defined by upwardly extending arcuate section 170 with planar base 162 is adapted to receive the beaded edge 42 of a vinyl liner 44. Gusset 172 secured to post member 102 provides vertical support to coping 157. The coping embodiments of my invention shown in FIGS. 1 and 7 are intended to be used with concrete decks about in-ground installations.

Figure 8:
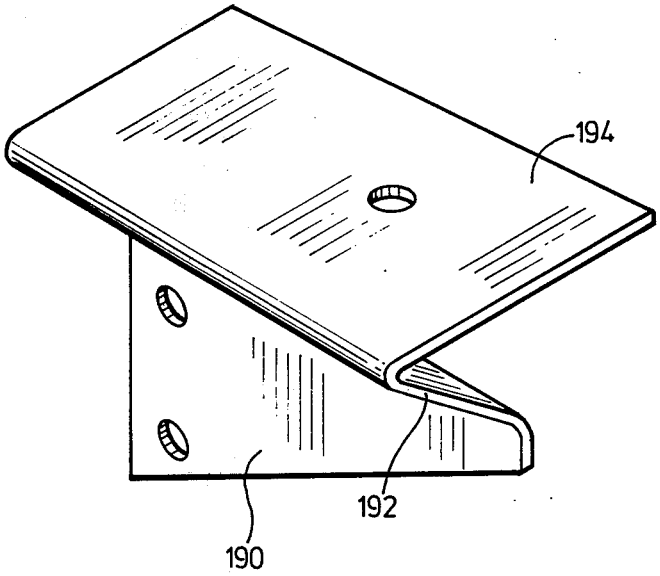
FIG. 8 is a perspective view of a gusset.

FIG. 8 is a perspective view of the metal gusset 172 wherein main planar portion 190 is adapted to be secured to section 106 of member 104 by bolts or the like 103 and diagonal web 192 depending therefrom supports top flange 194.

Figure 9:
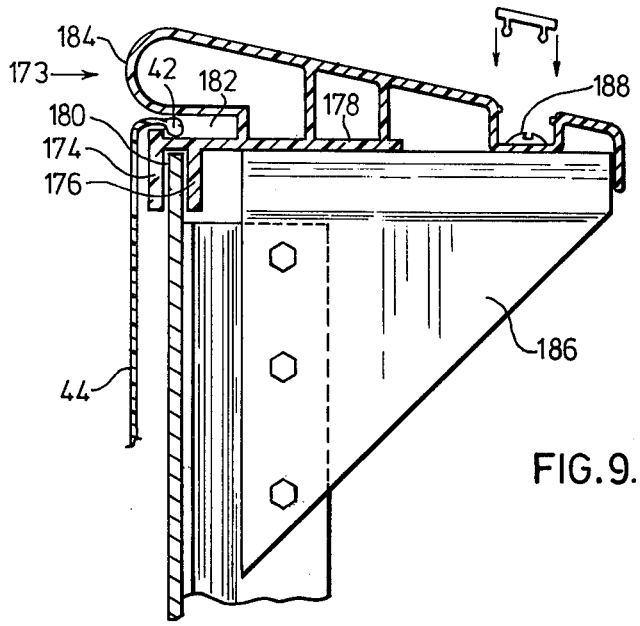
FIG. 9 is a section of still another version of coping.

FIG. 9 shows still another embodiment of coping 173 in which a pair of downwardly depending spaced flanges 174, 176 from planar base 178 define recess 180 which receives the upper edge 166 of panel 10. A recess 182 defined between upwardly extending arcuate section 184 and the front edge of planar base 178 is adapted to receive the beaded edge 42 of vinyl liner 44. Coping 173 is secured directly to gusset 186 by securing means such as screws, rivets or bolts 188.

What I claim as new and desire to protect by Letters Patent of the United States is:

1. A sectional wall comprising, in combination: a plurality of rectangular wall panels each having top and bottom edges and parallel side edges, a longitudinal flange formed along each side edge defining an acute angle with the plane of the panel, whereby said flanges diverge from each other to form an angle with each other when said panels are in alignment with or perpendicular to each other, and an elongated connected defining a pair of opposed converging faces adapted to receive said diverging flanges in abutment whereby said panels are rigidly connected together, said connector comprising a pair of elongated members each having an arcuate section and a planar section whereby said arcuate sections are inwardly concave to form the opposed converging faces upon abutment of said planar sections upon each other for engaging the diverging flanges.

2. A sectional wall as claimed in claim 1, in which said arcuate sections have a reverse flange formed thereon substantially perpendicular to said planar sections for abutment against the adjacent panel when said panels are in alignment with each other.

3. A sectional wall as claimed in claim 1, an elongated member arcuate in section having a flange depending outwardly from said section adapted to be secured between the planar sections of said pair of elongated members.

4. A sectional wall as claimed in claim 1, in which a reinforcing gusset is formed integral with or secured to each elongated connector to define a supporting surface co-planar with the top edge of each wall panel and each of said wall panel top edges has alternating sections offset to form a projected recess, an elongated cap having a front flange is adapted to seat in said projected recess and an elongated coping is adapted to be secured to said cap and extend along the length of the wall.

5. A sectional wall as claimed in claim 3 additionally comprising a reinforcing gusset formed integral with or secured to each elongated connector, an elongated coping having a planar base and a recess formed along one edge of said base for receiving the top edge of said panels, means for securing said coping to said gussets, and said coping having an arcuate section depending upwardly from said base defining with said base an elongated recess extending in proximity to the top edge of said panels for receiving an edge of a liner therein.

6. A sectional wall as claimed in claim 4 in which a rigid elongated extrusion having a planar base with a downwardly depending front flange is adapted to overlie said cap, said base having an upwardly extending section in proximity to said front flange defining a pair of forwardly extending recesses for receiving an edge of a liner and for securing said coping to the cap.

7. A sectional wall as claimed in claim 6 in which said coping has an upwardly extending front convex section and a rearwardly sloping substantially planar exterior surface substantially co-extensive with the said gussets.

8. A sectional wall as claimed in claim 5 in which said coping has an upwardly extending convex section for receiving and defining an edge of a concrete deck.

9. A sectional wall as claimed in claim 1 in which said arcuate sections have a reverse flange formed thereon substantially perpendicular to said planar sections for abutment against the adjacent panel when said panels are in alignment with each other, a reinforcing gusset is formed integral with or secured to each elongated connector to define a supporting surface co-planar with the top edge of each wall panel, and an elongated coping having a width substantially equal to the reinforcing gussets is adapted to engage the wall panel top edges and to be secured to said gussets.

10. A sectional wall as claimed in claim 9 in which said elongated coping has a base, an arcuate front section having a convex exterior surface extending upwardly from said base defining with said base an elongated recess adapted to receive and retain a beaded edge of a pool liner, a pair of downwardly depending spaced flanges formed on said base defining a recess for receiving the wall panel edge, means for securing said coping to the gussets, and said elongated coping has a rearwardly sloping substantially planar exterior surface with a longitudinal recess for receiving said securing means.

11. A sectional wall as claimed in claim 10 in which said gusset is formed separate from the elongated connector and has a planar portion adapted to be secured to the said connector, a top flange adapted to underlie and be secured to the base of the coping, and a diagonal web joining said planar portion to the top flange.

* * * * *